United States Patent [19]

Lynch

[11] Patent Number: 4,878,832

[45] Date of Patent: Nov. 7, 1989

[54] BURNER ILLUMINATOR DEVICE

[76] Inventor: Michael B. Lynch, 717 King St., Alexandria, Va. 22314

[21] Appl. No.: 200,037

[22] Filed: Oct. 23, 1980

[51] Int. Cl.[4] ..... F23D 3/28

[52] U.S. Cl. ..... 431/120; 431/126; 431/325

[58] Field of Search ..... 431/320, 120, 126, 323, 431/325, 298; 44/59; 206/602, 608; D73/1 R; 362/101, 161

[56] References Cited

U.S. PATENT DOCUMENTS

| | | | |
|---|---|---|---|
| 133,479 | 11/1872 | Higgins | 362/161 |
| 192,294 | 6/1877 | Simmonds | 431/298 |
| 2,246,346 | 6/1941 | Carroll | 431/298 |
| 2,784,581 | 3/1957 | Quandt | 431/320 X |
| 3,434,789 | 3/1969 | Haller | 431/298 |
| 3,790,332 | 2/1974 | Woollars | 431/298 X |
| 4,019,856 | 4/1977 | Lacroix | 431/320 X |
| 4,102,634 | 7/1978 | Crisp | 431/320 X |
| 4,110,066 | 8/1978 | Murphy | 431/320 |
| 4,134,718 | 1/1979 | Kayfetz et al. | 431/320 X |

FOREIGN PATENT DOCUMENTS

| | | | |
|---|---|---|---|
| 542948 | 2/1942 | United Kingdom | 431/298 |

*Primary Examiner*—Randall L. Green
*Attorney, Agent, or Firm*—Robert J. Koch

[57] ABSTRACT

A disposable burner illuminator device comprises a buoyant flotation collar of substantially flat configuration having at least one wick member receiving aperture, a reflector foil layer supported on one surface of the buoyant flotation collar and a wick member extending through the receiving aperture and having a larger diameter at the wick end extending through the surface supporting the reflector foil layer than the diameter of the receiving aperture. This device may be utilized individually or with a plurality of wick member receiving apertures and a plurality of wick members. A plurality of the devices may be formed as a booklet or card having several burner illuminator devices which can be torn off or separated from the card and utilized individually or in groups.

4 Claims, 2 Drawing Sheets

BURNER ILLUMINATOR DEVICE

BACKGROUND OF THE INVENTION

1. Field of the Invention:

This invention relates to a disposable burner illuminator device for use with combustible oil. More particularly, the device is designed for use in vegetable salad oil and water lamps as an illuminator device or in chafing or warming vessels as a burner device.

More specifically, the invention relates to a preassembled, ready-to-use, disposable unit comprised of a flotation collar having a small wick attached to the-center thereof as well as to kits for such devices. It is designed preferably for a single use as a burner illuminator device to float a live flame upon a body of vegetable oil placed on the top of water in a vessel for use as a practical source of useful light and/or heat energy.

2. Background of the Prior Art:

The principle of floating a live flame upon oil as a source of useful illumination and heat energy is ancient and predates the invention of the candle. An of such early devices is found in U.S. Pat. No. 4,057,786. A number of illuminator and burner devices have been suggested in modern times, all of which are intended for repeated use; that is, they are of the more permanent type, buoyant flotation collars, designed to receive a fresh replacement wick to renew the burned out wick previously employed. An example of such arrangements are found in U.S. Pat. Nos. 3,183,688 and 2,246,346. Such devices are generally more elaborate, more expensive and with continued use are ultimately less efficient than the device herein described. The chief objection to these more permanent type devices is the maintenance required, which is an unpleasant, messy, oily task of washing the device in warm soapy water, a necessary chore to remove the residual oil that clings to the device after use, which must be removed before storing away for reuse; failure to do so results in a sticky dust collector, becoming a dirty, inefficient device that could become a dangerous fire hazard if continually stored and reused without cleaning. But usually such devices are discarded long before their full potential usefulness because of the unpleasant maintenance required.

In any case, even if well maintained, such devices decrease in efficiency with increased usage and offer false fuel economy and decreasing efficient light and heat energy in the long run.

SUMMARY OF THE INVENTION

The primary object of the invention is to make more practical, widespread use of the ancient principle of floating a live flame upon oil to provide a useful source of light and heat energy by providing a new and improved product of manufacture that will eliminate the inherent unpleasant maintenance problem of replacing wicks, cleaning and storage for reuse associated with all more permanent buoyant reusable wick holder illuminator or burner devices.

Further, it seeks to encourage a greater application and extended usefulness of this useful source of light and heat energy by replacing all such wick holder, illuminator or burner devices that require wick replacement and general maintenance with the novel, disposable, maintenance-free flotation collar and wick unit claimed herein which is as effortless to dispense, ready for immediate use, as, for example, a match from a matchbook, and as easily disposed of as a tea bag.

Because of its simplicity, economy and convenience, this invention may be utilized as a source of practical energy for small jobs requiring a safe, controlled light and heat source.

One thinks of such devices being used only for religious, devotional lamps, night lamps, or as pretty decorative accent candles. This invention, however, includes all of these uses, but because of its novel construction and convenience, it lends itself to far more utilitarian and aesthetic uses.

The above-noted objects and advantages are achieved, therefore, by a disposable burner illuminator device comprising a buoyant flotation collar of substantially flat configuration having at least one wick member receiving aperture, a reflector foil layer supported on one surface of the buoyant flotation collar and a wick member extending through the receiving aperture and having larger diamensions at the wick end extending through the surface supporting the reflector foil layer than the dimensions of the receiving aperture. This disposable burner illuminator device may also comprise a plurality of the wick member receiving apertures with each aperture having a wick member extending through one of the receiving apertures. Such a device has a particularly advantageous structure and can form a booklet or card having several burner illuminator devices which can be torn off or separated from the card and utilized individually. To facilitate such a structure, the supply booklet or card may contain perforations or prestressed tear lines.

Another embodiment of the present invention provides for a disposable burner illuminator kit comprising the buoyant flotation collar with a reflector foil layer as previously described and a plurality of wick members capable of insertion into the wick member receiving aperture or apertures. The disposable burner illuminator kit provides the flexibility of inserting the particular style or design of the wick member for insertion into the wick member receiving aperture or apertures. The wicks, for example, may take the form of a single wedge wick wherein one end of the wick is flattened into a wedge-like shape, a double wedge wick wherein a single wedge wick is flattened at the end opposite the first wedge shape into a second wedge shape after insertion into the wick member receiving aperture. A third type of wick comprises a loop wick wherein both ends of the wick member extend outwardly on the same side of the flotation collar with the loop extending on the opposite side of the flotation collar. The loop wick facilitates the high speed assembly of the disposable burner illuminator device and consequently comprises a preferable construction for the device in individual or booklet or card form rather than the disposable burner illuminator kit.

The disposable burner illuminator device and components thereof are manufactured according to the invention by a method which in its simplest form merely comprises the insertion of the wick member into the wick member receiving aperture of a buoyant flotation collar and flattening at least one end of the wick member. The flattening operation forms a wedge-shaped wick which is held in place on the buoyant flotation collar by the breadth of the wedge-shaped wick end which can no longer easily pass through the wick member receiving aperture. The wick member may, of course, be flattened at both ends and thereby essentially prevent movement of the wick in either direction.

In another embodiment of the invention, the disposable burner illuminator device may be mass produced by the process including simultaneous insertion of the wick member and stamping of the flotation collar to produce the tear line which facilitates the removal of a portion of the flotation collar and one wick member to be used as an individual burner illuminator device. After the insertion and stamping steps, the plurality of wick members extending from the flotation collar may be flattened simultaneously. In addition the wick members may be treated simultaneously with various treatment agents, for example, an oil absorption indicator solution or various combustion aid components. These embodiments will, of course, be described in further detail in the description which follows and will be demonstrated in the accompanying drawings.

Figure 1:
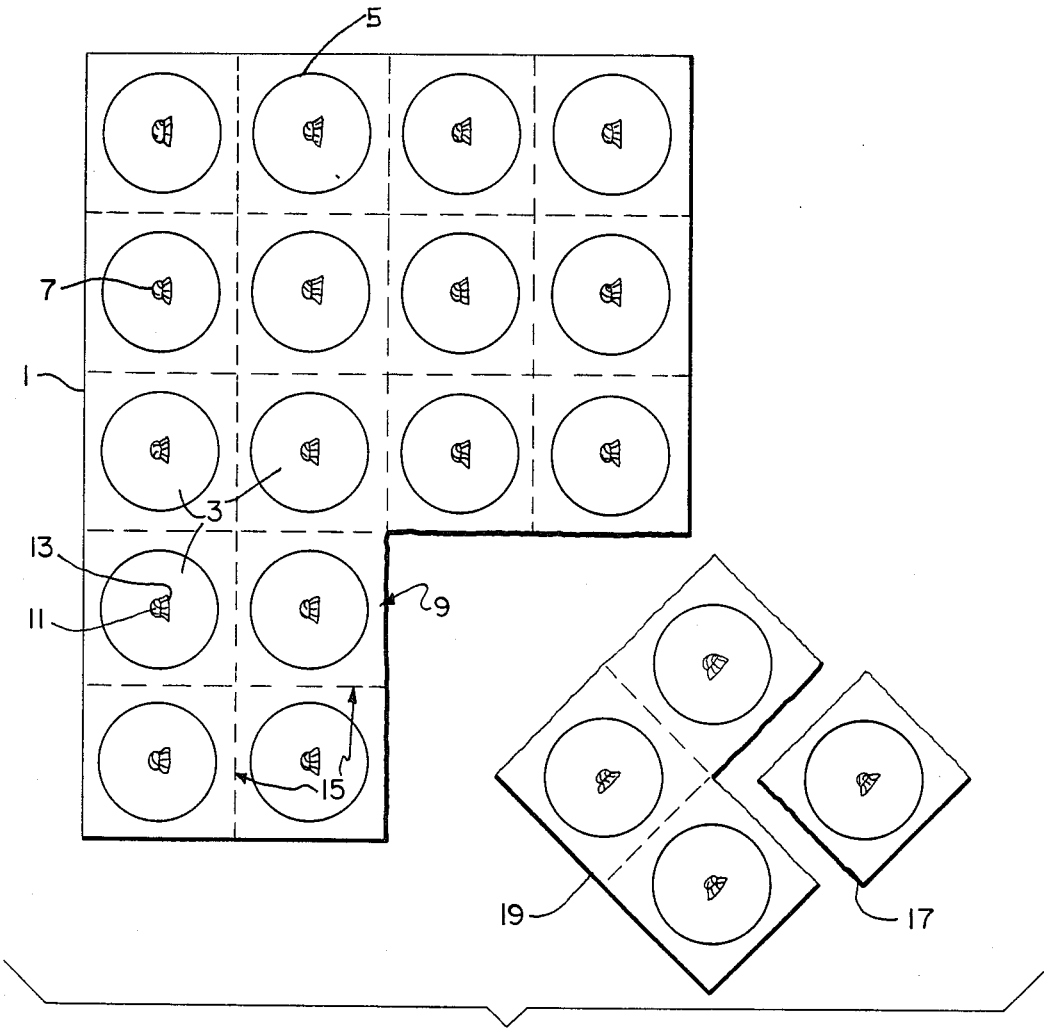
FIG. 1 shows a top plan view of a disposable burner illuminator device embodying the invention.

In a preferred embodiment of the invention, a number of these novel float and wick units are removably die-cut into single, convenient-sized sheets of foil-clad material. The sheet, made of the same material as the units, services as a self-contained carrier sheet/dispenser means for the individual float and wick units, which may be easily removed one or more at a time as needed for use in oil and water lamps as illuminators, or in oil and water chafing or warming dishes as a burner to replace such other burner devices as Sterno-type canned heat burners, when a safer controlled means is desired.

In another embodiment of the invention, a section of the foil-clad buoyant carrier sheet may be cut along the scored blank border area surrounding the float and wick units, thus forming a gang or cluster of several units to be used in a suitable size vessel of oil and water for light or heat.

In yet another embodiment of the invention, the entire carrier sheet may be used and floated upon oil placed on water in a suitable size vessel, thus giving a number of illuminators or burners, depending upon the number of individual units die-cut thereupon.

Thus individual units can be selected for use as a single illuminator or burner or several or all units as are die cut into the said carrier sheet can be used. In this case, the carrier sheet and die-cut units would serve as a hot plate or multi-light illuminator.

The amount of light or heat generated by the flame can be controlled simply by igniting the desired number of wicks attached to the individual units on the carrier sheet to provide concentrated or distributed light and/or heat for specific uses.

For example: when employed as a utilitarian burner device for slow, low-heat cooking or warming, a pan holding the food would receive even heat throughout the entire bottom surface thereof, thus insuring even distribution of heat as does a hot plate or kitchen stove.

In an embodiment demonstrating the decorative uses, only several wicks on the carrier sheet might be ignited to create special aesthetic effects in conjunction with, say, a colorful contoured or plain design, that may be imprinted or formed on the surface of the reflective foil-clad carrier sheet and die-cut units, to create a light and shadow pattern on the wall or ceiling.

For economy of both material and manufacture the above-mentioned means of packaging the units in its self-contained dispenser carrier sheet is preferred.

In addition to the optional control of increasing and intensifying the light and heat by using several units simultaneously, another means of intensifying the ignited flame is provided inherently in all of the novel float and wick units and is claimed herein as part of the invention.

The carrier sheet and the die-cut float and wick units, removably attached thereto, are made of the same shiny foil-clad buoyant material. At the time of manufacture, the individual units are formed into plain, concave, or convex surfaces which serve as a front surface mirror reflector to concentrate or distribute the light and/or heat of the ignited flame on each unit; this highly reflective surfaced device is designed to magnify the light and amplify the heat energy produced by the small flame so as to increase the efficiency of each small flame on every unit.

For maximum brilliance and efficiency, the units are designed preferably for a single use.

Another inherent control provided in this sytem of lighting and heating is time and temperature control, which is automatic when the principles are understood and applied.

Time control: whereas, the novel float and wick unit is designed to be floated upon oil placed on water in a vessel for use, the function of the water needs to be explained.

The water serves three purposes:

1. It serves as a cooling system for the oil, which might become too hot and ignite the entire surface of oil, if the water were not there to cool the oil.

2. Water is used to support any desired amount of oil at a specific predetermined level for the most effective placement and use of the oil.

3. The water supporting the oil is an automatic extinguisher for the flame; upon the total consumption of the oil placed on the water, the float and wick unit rests on the water; the wick by the same capillary attaction which supplied a steady flow of oil to the flame, now imbibes the water and thus extinguishes the flame. The water supply below the oil therefore is a practical time control for a lamp or burner device when supplied with a specific, measured amount of oil; it will burn a specific length of time and then extinguish itself.

Temperature control: whereas the wick attached to the prefabricated float and wick unit is small, for general use, for a single, one-time buring the wick is in the order of ½ inch long, the thickness of the wick, therefore, determines the intensity of light and heat produced. The wick serves as does a gas jet orifice, a thin wick, less flame and a thicker wick, more flame; thus lower or higher intensity, temperature depends on the wick thickness size.

Combining these principles, each package of float and wick units delivered to the market would include a data sheet or time and temperature table which would explain and give specific volume measurements of oil to be used for specific lengths of time with specific wick size units.

One method of producing the said illuminator/burner device, referred to herein as the "float and wick unit" and which offers perhaps the greatest economy of material and manufacture and which lends itself to high speed mass production, is as follows:

In a single simultaneous forming and die-cutting operation a number of floats, coincident with a carrier sheet means, which may serve as a convenient dispenser for the floats or as a hot plate gang burner, is produced by stamping into a convenient sized single sheet of foil-clad material. A heavy duty press equipped with a special combination matrix-die-cutting plate is employed which may have engraved upon it any desired design, shape or form in intaglio so as to be able to impress upon the foil-clad buoyant material, the design shape or form, from the plate, yielding thereby a relief or incised impression, particularly the forms of concave and convex shapes, which when formed on the highly polished surface of the foil-clad sheet serve as a front surface mirror reflector for the individual units die-cut into the carrier sheet.

Thus, in a single operation individual float units are formed and removably mounted to the self-contained carrier sheet/dispenser means, totally complete except for wicks.

The wicks for the individual units stamped into the said carrier sheet may be simultaneously attached to the units prior to, or during,the formation and die-cutting, if special tooling is provided or after the formation and die-cutting operation. Or, another option is to supply the wicks separately to be attached to the float at the time of use.

DESCRIPTION OF THE PREFERRED EMBODIMENTS

In one embodiment of the present invention, the disposable burner illuminator device comprises a thin sheet of buoyant material as shown in FIG. 1 in the form of a disposable burner illuminator carrier sheet or magazine 1. The carrier sheet comprises a plurality of single wick burners 3 each burner having a buoyant flotation collar 5, a wick member receiving aperture 7, a reflector foil member 9 and the wick member 11. As shown in FIG. 1, the wick member 11 extends through the receiving aperture 7 and is flattened at the wick end 13. Since the disposable burner illuminator devices are supplied together in the form of a coincident carrier sheet or magazine 1, they may be easily removed by separation along prestressed tear lines 15. Thus, an individual burner illuminator device 17 is shown in FIG. 1 as separated from a corner of the disposable burner illuminator carrier sheet. A multiple burner illuminator device 19 is provided by tearing several individual single wick burners as a group from the carrier sheet.

Figure 2:
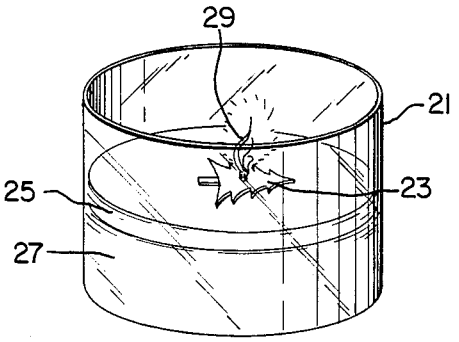
FIG. 2 is a side elevational view of a single burner illuminstor device in use.

In FIG. 2, a disposable burner illuminator device is illustrated in use in a glass vessel 21. A single wick burner illuminator device 23 floats on top of a layer of vegetable oil 25. Vegetable oil of a specific measured quantity forms a layer on top of a substantial volume of water 27 within the vessel 21. The quantity of oil is selected to sustain the flaming combustion in the wick member 29 for a desired period of time. After the oil is consumed by absorption through the bottom portion of the wick (not shown) to supply the flaming combustion on the reflector side of the wick member, the flaming combustion is extinguished due to the final consumption of the oil and, in some instances, the absorption of water into the wick member.

Figure 3:
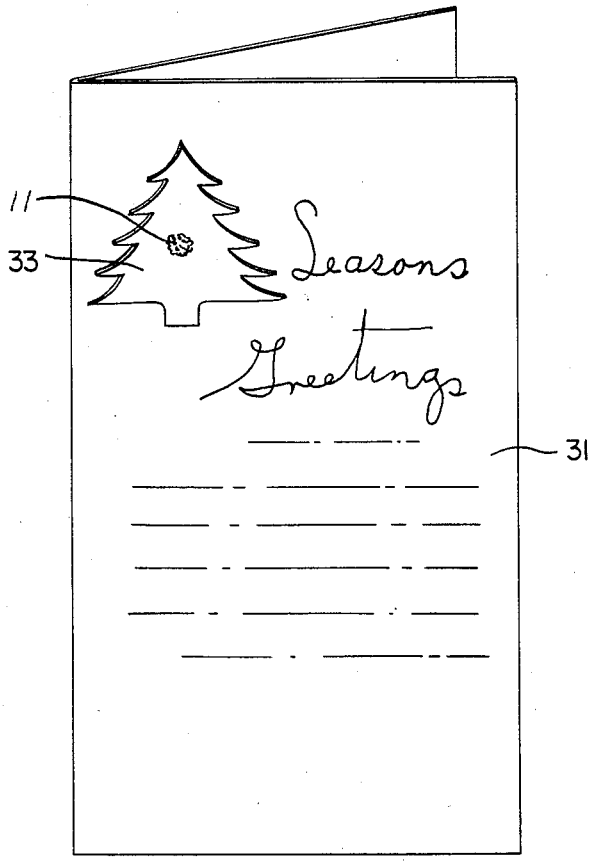
FIG. 3 is a front view of a greeting card carrying a disposable burner illuminator device embodying the invention.

FIG. 3 illustrates an embodiment of the present invention wherein a greeting card 31 is provided with a single wick burner illuminator device 33. The single wick burner may be attached to the greeting card by means of an adhesive material or may be die stamped into the greeting card itself which preferably comprises a coincident carrier sheet of foil clad buoyant material. Use of the single wick burner 33 is accomplished by simple removal along precut stress lines or removal in the area of the adhesive material depending upon the particular construction of the card and placement in a glass vessel as shown in FIG. 2. The wick member 11 of the single wick burner illuminator device 33 may be easily ignited by contact with a flaming combustion source such as a match, cigarette lighter or the like either before placement in the glass vessel 21 or after flotation upon the vegetable oil layer 25.

Figure 4:
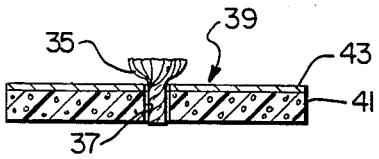
FIGS. 4 through 9 show a sectional view of several different forms of the disposable burner illuminator device according to the invention.

FIGS. 4 through 10 illustrate several alternative embodiments of wick members according to the present invention. FIG. 4 illustrates a single wedge wick 35 extending through the wick member receiving aperture 37 of a buoyant flotation collar 39. As shown in FIG. 4, the buoyant flotation collar comprises a styrofoam disc member 41 having a metal foil layer 43 laminated thereto.

Figure 5:
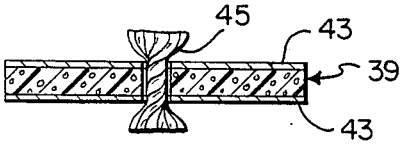

FIG. 5 illustrates a double wedge wick having flattened ends extending on both sides of the buoyant flotation collar 39. With the double wedge wick, it is advantageous to employ a metal foil laminate 43 on both sides of the styrofoam disc 41.

Figure 6:
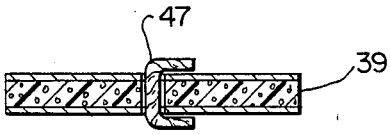

FIG. 6 also discloses a double wedge wick 47 which has been mass produced or flattened by passing the buoyant flotation collar through a pair of roller members during manufacture.

Figure 7:
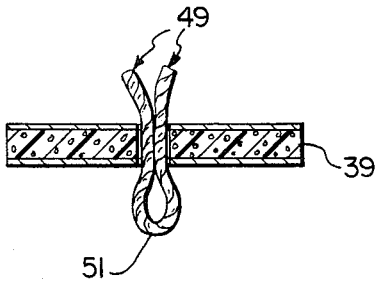

In another particularly advantageous embodiment of the present invention, a loop wick is illustrated in FIG. 7. The wick ends 49 extend on the same side of the buoyant flotation collar 39. In this manner, a loop 51 is formed on the opposite side of the buoyant flotation collar 39. This particular embodiment can easily be mass produced preferably by insertion of a plurality of wick members simultaneously on a disposable burner illuminator carrier sheet.

Figure 8:
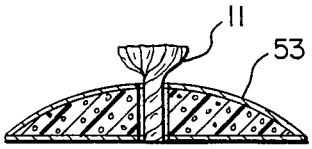
Figure 9:
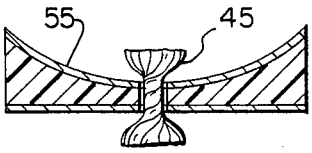

In FIGS. 8 and 9, disposable burner illuminator devices are shown having specially designed reflector portions. In FIG. 8 the reflector portion closest to the wick member 11 displays a convex reflector surface 53. In FIG. 9, the reflector surface closest the double wedge wick 45 displays a reflector surface of concave shape 55. By the specific shape of the reflector surface interesting and advantageous illumination effects are accomplished according to the present invention.

Figure 10:
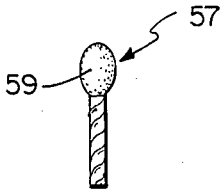
FIG. 10 is a side view of a wick member according to an embodiment of the invention.

FIG. 10 discloses a match wick 57. According to this embodiment, the wick member 11 is treated at one end with a combustible compound to form a combustible end portion 59 similar to a match head in design. While this "match wick" could be struck in the manner of a match for ignition, it is preferable to first permit the wick to absorb oil and then ignite the combustible end portion 59 by contact with a source of flaming combustion.

Figure 11:
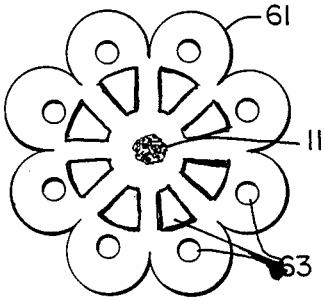
FIG. 11 is a top plan view of a disposable burner illuminator device of special design and construction according to a preferred embodiment of the invention.

Highly unusual optical effects can be obtained by employment of a special design reflector 61 as shown in FIG. 11. Such a reflector in the form of a snowflake or flower, for example, contains a plurality of optical reflection apertures 63 which permit light from the wick member 11 during combustion to pass through the reflector member and into the oil and water layers respectively. The reflection of the light in this manner produces interesting refractions and reflective optical designs.

Although a prefabricated, preassembled float and wick unit having a wick attached at the time of manufacture and being removably mounted on a carrier sheet is the preferred means of supplying this product, this invention does not preclude the possibility that, for convenience of manufacture, economy of production, or good marketing reasons, this product might be presented differently.

For example: it may be decided to eliminate the wick attachment operation altogether and supply the wick and float separately, in which case, this invention provides for such an eventuality and claims herein, as part of this invention, a kit having novel wick precut of proper size and designed for maximum efficient burning, that is especially designed for the novel float and is referred to herein as a single wedge wick (FIG. 2) and would be supplied as a number of loose, individual, precut wicks separately packaged t be manually inserted into the centrally located orifice of each flotation collar.

Further: it might be decided to supply the flotation collars separate from the carrier sheet with or without wick attached, in any case, if the units are supplied, on or off the carrier sheet with or without wicks, the basic concept remains the same, that is, this invention claims a handy, disposable, inexpensive, fresh, clean, dry, flotation collar unit or cluster of units with or without wicks for immediate use and having a convex, concave or plain front surface mirror type reflector to control and amplify the heat and light from the ignited wick that it supports in an upright position while it is being floated upon a body of oil placed on water in a vessel and which allows the centrally attached wick to absorb uniformly the oil through capillary attraction, thus providing a steady supply of the said oil upon which it floats, to the flame through the ignited wick.

MATERIAL AND CONSTRUCTION

The carrier sheet and the individual flotation collar units are formed and removably die-cut into the same prepared sheet of flat stock foil-clad buoyant material.

To prepare the material for use, a convenient size, single sheet of thin flat stock, oil-impervious, buoyant material, made of either organic matter such as loose spongy plant tissue such as true pith or of inorganic matter such as styrofoam, foamcore, or other such plastic foam material or of thin waxed corrugated cardboard, laminated on at least one side thereof with a thin sheet of shiny foil such as aluminum foil, which is bonded to the buoyant material by a suitable oil-impervious adhesive.

The laminated foil fixed to the buoyant flat stock material serves two functions. One, it reflects the heat generated by the ignited wick away from the delicate plastic foam material, which would otherwise melt the plastic foam around the centrally located orifice which supports the wick in an upright position and would otherwise, without the foil, allow the wick to fall through the expanded melted orifice into the oil upon which it floats, thus extinguishing the flame. The foil laminated to wax cardboard does the same thing and also prevents the flame from burning the cardboard.

Too, the highly polished foil further serves as a front surface mirror reflector to control and amplify the heat and light generated by the ignited wick's flame.

What is claimed is:

1. A method of making a disposable burner-iluminator device comprising:

inserting a wick member into a receiving aperture in a buoyant flotation collar, flattening at least one end of said wick member to extend the diameter of said end larger than the diameter of said receiving aperture.

2. The method of claim 1 further comprising:

treating said wick member with an oil-soluble dye which colors said wick member upon dissolution in oil and adsorption of oil in said wick member.

3. The method of claim 1 further comprising inserting a wick member into each of a plurality of receiving apertures and forming prestressed tear lines about each inserted wick member.

4. The method of claim 1 wherein said inserting step and said tear line forming step are performed simultaneously.

* * * * *